US006536623B1

(12) United States Patent
Sutcliffe

(10) Patent No.: US 6,536,623 B1
(45) Date of Patent: Mar. 25, 2003

(54) GUMBALL MACHINE DISPENSING WHEEL IMPROVEMENT

(76) Inventor: James Gregory Sutcliffe, 640 Big Buck Blvd., Orangeburg, SC (US) 29115

( * ) Notice: Subject to any disclaimer, the term of this patent is extended or adjusted under 35 U.S.C. 154(b) by 0 days.

(21) Appl. No.: 09/981,426

(22) Filed: Oct. 17, 2001

(51) Int. Cl.[7] ..... A24F 15/04
(52) U.S. Cl. ..... 221/24; 221/265
(58) Field of Search ..... 221/24, 155, 265, 221/194, 195, 196, 200, 203

(56) References Cited

U.S. PATENT DOCUMENTS

| | | | | |
|---|---|---|---|---|
| 2,880,906 A | | 4/1959 | Probasco | |
| 3,018,148 A | | 1/1962 | Probasco | |
| 5,191,998 A | * | 3/1993 | Schwarzli | 221/203 |
| 5,452,822 A | | 9/1995 | Hammond | |
| 5,833,117 A | * | 11/1998 | Kovens et al. | 221/24 |

OTHER PUBLICATIONS

"The Northwestern Corporation Ordering Information and Price List," Jun. 2001, discloses various dispenser assemblies and dispenser parts. Particularly relevant to the present application are the dispenser (or capsule) wheels.
"The Northwestern Corporation Ordering Information and Price List," effective Jan. 2001, discloses various dispenser assemblies and dispenser parts.

* cited by examiner

*Primary Examiner*—Kenneth W. Noland
(74) *Attorney, Agent, or Firm*—Michael A Mann; Nexsen Pruet Jacobs & Pollard LLC

(57) ABSTRACT

An improvement in the design of gumball dispensing mechanisms is described, and, more specifically, resides in the size and shape of the gumball dispensing openings formed through the dispensing wheel. In one embodiment, the openings are generally arcuate shaped, and in another embodiment they are generally "peanut" shaped. In either case, the openings are designed to dispense two large gumballs, relatively jam-free, for each use of the gumball machine by a customer.

17 Claims, 2 Drawing Sheets

GUMBALL MACHINE DISPENSING WHEEL IMPROVEMENT

FIELD OF THE INVENTION

The present invention relates generally to gumball machines, and, more particularly, to improvements in the dispensing wheel used for dispensing gumballs.

BACKGROUND OF THE INVENTION

Gumball machines are well known in the art and are generally made of a metallic frame coupled to a transparent storage container for holding a supply of gumballs, a coin-operated dispensing mechanism, and a coin collection container. Generally, gumball machines dispense round gumballs of various sizes, and usually only one gumball at a time, although some machines are known to dispense two small gumballs.

It is well known that gumballs come in different sizes with the most common size being the one inch diameter size. The one inch diameter gumballs are dispensed one-at-a-time; however, some of the smaller sizes can be and are dispensed two-at-a-time.

To be able to dispense gumballs, the dispensing mechanism of a gumball machine includes a circular, ribbed dispensing wheel. Generally stated, the dispensing wheel is turned through an arc of 120° with each dispensation. Therefore, to dispense a one-inch gumball with each dispensation, each of the three 120° sections contains an aperture having a diameter that is slightly larger than one inch for carrying the gumball to the outlet chute and, therefore, out of the machine. For those dispensing mechanisms that dispense two smaller sized gumballs, they are designed to have two smaller apertures, side-by-side, in each 120° section.

A somewhat common problem associated with some of the dispensing mechanisms used in gumball machines is that they have a tendency to jam during operation. This, in many instances, is caused by a gumball not being properly seated in the dispensing mechanism, either by a gumball that the machine was designed to dispense or by an extra gumball becoming partially seated in a dispensing wheel aperture, or by becoming lodged between an aperture and one of the other parts of the gumball machine including those associated with the dispensing mechanism. Along this line, some gumball vendors have even tried to dispense two one-inch gumballs by using other types of dispensing wheels that are currently available on the market, e.g., some vendors have replaced their standard dispensing wheel with a toy dispensing wheel which, because of jamming problems, has proved to be unsuccessful for dispensing two one-inch gumballs.

Therefore, there remains a need, and it would be highly desirable, to have a gumball machine that has a dispensing mechanism that can dispense two large gumballs during each dispensing cycle, while being relatively jam-free.

SUMMARY OF THE INVENTION

According to its major aspects and briefly recited, the present invention is an improvement to the dispensing mechanism used in gumball machines. More specifically, the improvement resides in the ribbed dispensing wheel of a gumball machine, which is a part of the gumball dispensing mechanism, and the improvement thereon allows the dispensing mechanism to dispense two large, one-inch gumballs, relatively jam-free. This is accomplished by fabricating appropriately sized crescent shaped openings through the ribbed dispensing wheel. In another embodiment of the present invention, the openings through the ribbed dispensing wheel are appropriately sized peanut shaped openings.

A feature of this invention is that it only requires the use of a single opening per dispensing cycle, which will provide the benefit of minimizing manufacturing costs.

Another feature of this invention is that many standard gumball machines would only require no, or merely simple, design modifications to be able to use the present invention.

An advantage of the present invention is that the improvement allows the gumball machine to remain relatively jam-free, while additionally benefitting the user by dispensing more gumball per dispensing cycle.

Other features and their advantages will be apparent to those skilled in the art of gumball machine design and operation from a careful reading of the Detailed Description of Preferred Embodiments, accompanied by the drawing.

BRIEF DESCRIPTION OF THE DRAWINGS

In the figures.

DETAILED DESCRIPTION OF PREFERRED EMBODIMENTS

The use of the terms "hole" and "opening" when used in the following paragraphs generally refers to the aperture formed on the dispensing wheel that allows a gumball to travel from the storage container to the user during a dispensing cycle. Generally, a gumball from a gumball storage container is carried by these apertures until it is dispensed from the gumball machine during a dispensing cycle, which is described below. Accordingly, these terms should be considered as interchangeable when either of these terms is used in that context.

The use of the term "dispensing cycle" when used in the following paragraphs generally refers to a user inserting a coin into the gumball machine; turning the handle to operate the dispensing mechanism, which causes a dispensing wheel having gumball carrying dispensing openings align with a dispensing chute; and having a gumball, or other appropriate item, dispensed to the user by falling due to gravity from the dispensing opening through the dispensing chute.

The present invention is an improvement to the gumball dispensing mechanism used in gumball machines, and, more specifically, resides in the ribbed dispensing wheel, which is a commonly known and used part of the dispensing mechanism in most standard gumball machines. Generally, the ribbed dispensing wheel works by being geared to a handle that operates the gumball machine after the user inserts a coin of the appropriate denomination into a coin collecting slot. By turning the handle, a gear or sprocket that is attached to the handle is rotated, and since the teeth of the gear or sprocket engage the ribs of the ribbed dispensing wheel, the ribbed dispensing wheel is also rotated by an amount set by the gear ratio of the dispensing mechanism. As an example, if a gumball machine dispenses one gumball per dispensing cycle, and if the ribbed dispensing wheel has three dispensing openings formed therethrough, then the ribbed dispensing wheel will be rotated 120° per dispensing cycle.

Figure 1:
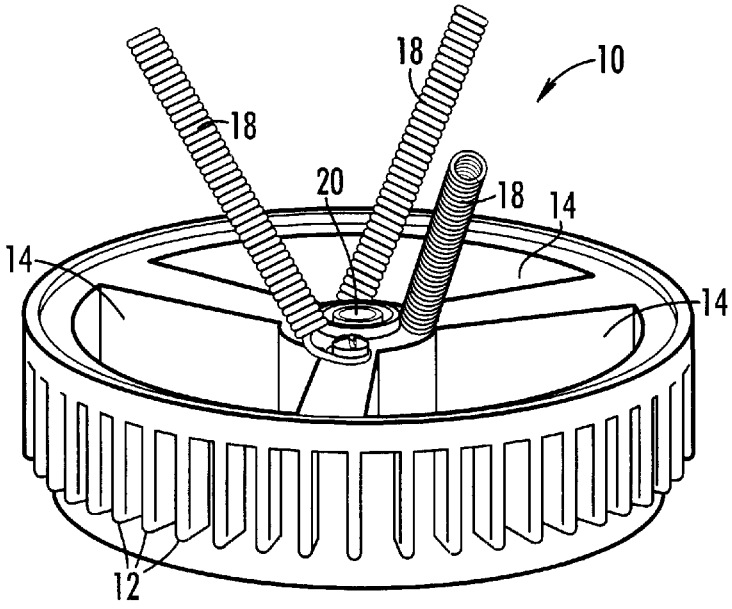
FIG. 1 is perspective view of the ribbed dispensing wheel, according to a preferred embodiment of the present invention.
Figure 2:
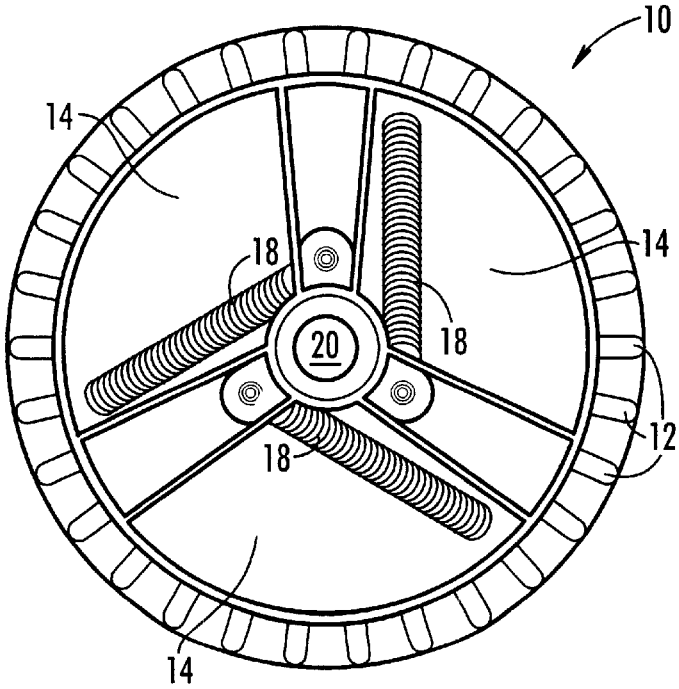
FIG. 2 is a bottom plan view of the ribbed dispensing wheel of FIG. 1.
Figure 3:
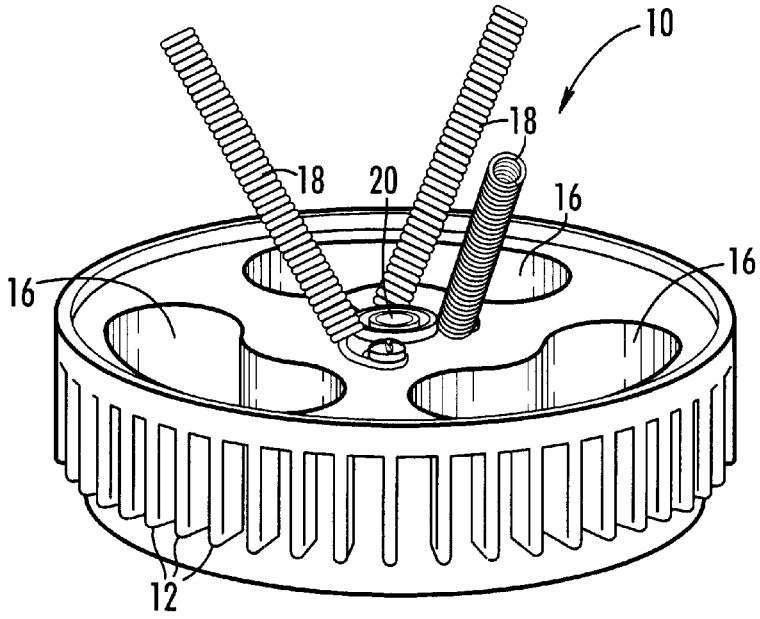
FIG. 3 is perspective view of the ribbed dispensing wheel, according to another preferred embodiment of the present invention.
Figure 4:
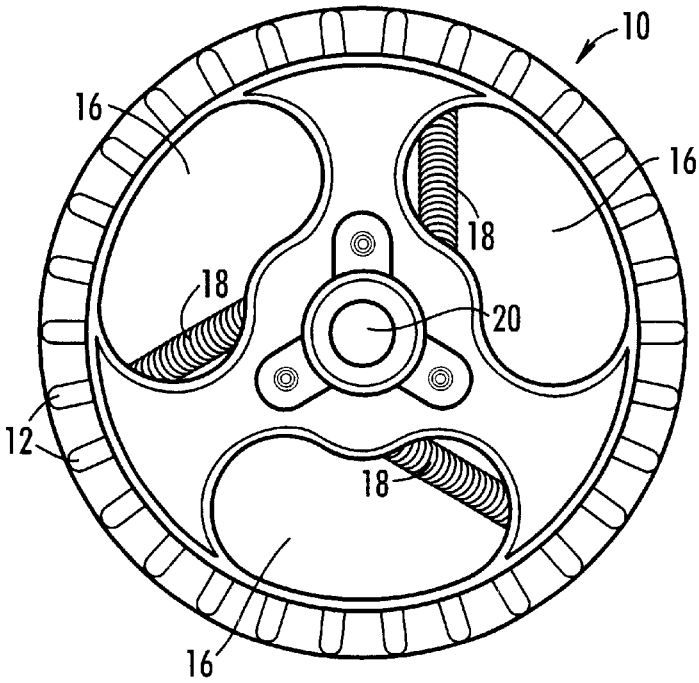
FIG. 4 is a bottom plan view of the ribbed dispensing wheel of FIG. 3.

Referring now to FIGS. 1 and 2, the ribbed dispensing wheel 10 is shown. Preferably, the ribbed dispensing wheel 10 is made of thermoplastic resins, but it can be constructed of any material that can withstand the stresses associated with gumball dispensing mechanisms. Preferably, the ribbed dispensing wheel 10 is fabricated using a plastic extrusion process; however, the fabrication of the ribbed dispensing wheel 10 including the forming of the dispensing openings (14, and 16 as shown in FIGS. 3 and 4) can be accomplished through any suitable process well known in the field of gumball machine fabrication and/or manufacture, or in any other field related to plastic or metallic part fabrication and/or manufacture. The ribbed dispensing wheel 10 is a part of a dispensing mechanism (not shown), and the ribs 12 are used to rotatably engage the ribbed dispensing wheel 10 to the teeth of a gear or sprocket that is attached to a user-operated handle (not shown) so that the ribbed dispensing wheel can be rotated by an appropriate amount to dispense two gumballs to the user per dispensing cycle. Preferably, the ribbed dispensing wheel 10 has three generally arcuate shaped dispensing openings 14 that are shaped so that they are easy to form during the manufacturing process. In another preferred embodiment, the dispensing openings 16 through the ribbed dispensing wheel 10 are "peanut shaped," as shown in FIGS. 3 and 4. By "peanut shaped," it is meant that the shape has two lobes connected by, at least, a narrowed open portion as shown in FIGS. 3 and 4, or a solid bridge portion that is not shown. Additionally, in another embodiment, the arc of the "peanut shape" is reversed so that a ray from the mid-point of the arc to the point that would be the center of the arc is directed away from the center of the ribbed dispensing wheel 10, not shown. Still, in another embodiment, the dispensing openings may be circular shaped and just touching at one point, or circular shaped with the shapes overlapping so that it has a "figure-eight" appearance. Preferably, with respect to any of these shapes, the dispensing holes (14 and 16), (or the other shaped dispensing holes described but not shown), need to be at least large enough to accommodate two one-inch diameter gumballs side-by-side, and they should be formed so that they are not any larger, unless manufacturing requirements dictate that a slightly larger opening is easier to form, or is structurally or operationally superior. By forming the holes in this way, and based on the ribbed dispensing wheel 10 being rotated 120° per dispensing cycle, the ribbed dispensing wheel 10 will be able to dispense two large gumballs per dispensing cycle.

Preferably, the ribbed dispensing wheel 10, as described, is designed so that it can readily replace the ribbed dispensing wheels currently being used in many of the standard and commonly found gumball dispensing machines currently being used on the market. Therefore, except for the inventive shapes of the ribbed dispensing wheel 10, many of the other aspects of the ribbed dispensing wheel 10 are well known in the field. For example, the ribbed dispensing wheel 10 has at least one agitator spring 20 attached to its upper surface for agitating the gumballs in the storage container, and, preferably, as shown in the figures, has three such agitator springs 20. Furthermore, since the ribbed dispensing wheel 10 is designed to readily replace those dispensing wheels that are already found in standard gumball machines, it is preferable that the ribbed dispensing wheel 10 of the present invention can be attached to a standard gumball machine with no, or very little, modification. Therefore, and for example, as is done for standard dispensing wheels found in 10 standard gumball machines, the ribbed dispensing wheel 10 of the present invention is attached to a standard gumball machine by sliding the ribbed dispensing wheel 10 over a center rod by passing the center rod through center opening 18 so that the ribbed dispensing wheel 10 rests upon other components of the dispensing mechanism and/or the gumball machine, and the ribbed dispensing wheel 10 is further held in place by having gumball machine components rest upon the ribbed dispensing wheel 10.

The fabrication of the ribbed dispensing wheel 10 of the present invention is not limited to the dispensing mechanism design, as shown. In this regard, those skilled in the art of gumball machine design or manufacture, or any other related art, will find that the design of the ribbed dispensing wheel can be accomplished in a variety of similar ways.

Therefore, while the preferred embodiments and the best mode of the present invention are described herein, it should be understood that the best mode for carrying out the invention herein described is by way of illustration and not by way of limitation. It is intended that the scope of the present invention includes all modifications that incorporate its principal design features, and that the scope and limitations of the present invention are to be determined by the scope of the appended claims and their equivalents.

What is claimed is:

1. A dispensing wheel for use in a coin operated gumball dispensing machine having a gumball storage container and a dispensing chute, said dispensing wheel comprising:

a generally solid, cylindrical shaped dispensing wheel, said dispensing wheel having radially extending ribs, said ribs meshing with the teeth of a gear, said gear being rotated by a user, said rotation of said gear causing said dispensing wheel to rotate around an axis, said generally solid, cylindrical shape defining at least three holes therethrough, said holes used for carrying two gumballs from said storage container of gumballs to said dispensing chute so that said two gumballs are dispensed to said user during said rotation of said dispensing wheel.

2. The dispensing wheel as recited in claim 1, wherein said dispensing wheel is made of plastic.

3. The dispensing wheel as recited in claim 1, wherein each gumball of said two gumballs is a "one-inch" gumball.

4. The dispensing wheel as recited in claim 1, wherein said holes are generally arcuate shaped.

5. The dispensing wheel as recited in claim 4, wherein said generally arcuate shaped holes are at least large enough to carry said two gumballs side-by-side.

6. The dispensing wheel as recited in claim 4, wherein said generally arcuate shaped holes are just large enough to carry said two gumballs side-by-side.

7. The dispensing wheel as recited in claim 1, wherein each gumball of said two gumballs is about one-inch in diameter.

8. The dispensing wheel as recited in claim 1, wherein said holes are generally "peanut" shaped.

9. The dispensing wheel as recited in claim 8, wherein said generally "peanut" shaped holes are at least large enough to carry said two gumballs side-by-side.

10. The dispensing wheel as recited in claim 9, wherein said generally "peanut" shaped holes are just large enough to carry said two gumballs side-by-side.

11. The dispensing wheel as recited in claim 1, wherein said dispensing wheel is made of metallic material.

12. A dispensing wheel for use in a coin operated gumball dispensing machine having a gumball storage container, a dispensing chute, and a dispensing cycle, said dispensing wheel comprising:

a generally solid, cylindrical shaped dispensing wheel, said dispensing wheel having radially extending ribs, said ribs meshing with the teeth of a gear, said gear being rotated by a user through said user's manual turning of an exterior handle, said turning of said exterior handle and said rotation of said gear causing said dispensing wheel to rotate around an axis, said generally solid, cylindrical shape defining at least three generally arcuate shaped holes therethrough, each of said generally arcuate shaped holes are used for carrying two gumballs from said gumball storage container to said dispensing chute so that for each said dispensing cycle said two gumballs are dispensed to said user by said rotation of said dispensing wheel.

13. The dispensing wheel as recited in claim 12, wherein said dispensing wheel is made of plastic.

14. The dispensing wheel as recited in claim 13, wherein said gumballs are at least one-inch in diameter.

15. A dispensing wheel for use in a coin operated gumball dispensing machine having a gumball storage container, a dispensing chute, and a dispensing cycle, said dispensing wheel comprising:

a generally solid, cylindrical shaped dispensing wheel, said dispensing wheel having radially extending ribs, said ribs meshing with the teeth of a gear, said gear being rotated by a user through said user's manual turning of an exterior handle, said turning of said exterior handle and said rotation of said gear causing said dispensing wheel to rotate around an axis, said generally solid, cylindrical shape defining at least three generally "peanut" shaped holes therethrough, each of said generally "peanut" shaped holes used for carrying two gumballs from said gumball storage container to said dispensing chute so that for each said dispensing cycle said two gumballs are dispensed to said user by said rotation of said dispensing wheel.

16. The dispensing wheel as recited in claim 15, wherein said dispensing wheel is made of plastic.

17. The dispensing wheel as recited in claim 16, wherein said gumballs are at least one-inch in diameter.

* * * * *